US011828509B2

(12) United States Patent
Pickett

(10) Patent No.: US 11,828,509 B2
(45) Date of Patent: Nov. 28, 2023

(54) REFRIGERATION SYSTEM USING AN ULTRASONIC TRANSDUCER TO INCREASE HEAT TRANSFER EFFICIENCY

(71) Applicant: Joshua R&D Technologies, LLC, Plano, TX (US)

(72) Inventor: David Pickett, Plano, TX (US)

(73) Assignee: Joshua R&D Technologies, LLC, Plano, TX (US)

( * ) Notice: Subject to any disclaimer, the term of this patent is extended or adjusted under 35 U.S.C. 154(b) by 0 days.

(21) Appl. No.: 17/689,073

(22) Filed: Mar. 8, 2022

(65) Prior Publication Data

US 2022/0196308 A1 Jun. 23, 2022

Related U.S. Application Data

(62) Division of application No. 17/214,237, filed on Mar. 26, 2021, now Pat. No. 11,274,867.

(60) Provisional application No. 62/994,921, filed on Mar. 26, 2020.

(51) Int. Cl.
*F25B 49/02* (2006.01)
*F25B 13/00* (2006.01)

(52) U.S. Cl.
CPC ..... *F25B 49/02* (2013.01); *F25B 13/00* (2013.01)

(58) Field of Classification Search
CPC ..... F25B 49/02; F25B 13/00
See application file for complete search history.

(56) References Cited

U.S. PATENT DOCUMENTS 5,218,828 A * 6/1993 Hino ..... F25C 1/00 62/534
5,371,019 A * 12/1994 Manz ..... G01N 33/0016 436/171
6,089,034 A 7/2000 Lake et al.
6,145,332 A * 11/2000 Hyde ..... G01F 23/74 62/190
2005/0016380 A1* 1/2005 Matsuura ..... B01D 5/0027 96/389
2006/0137366 A1 6/2006 Kang et al.
2008/0115523 A1 5/2008 Bailey et al.
2010/0140928 A1* 6/2010 Becker ..... F16L 19/10 285/321
2010/0329903 A1* 12/2010 Fong ..... F03D 9/17 137/12
2011/0308267 A1 12/2011 Tamaki et al.
2016/0195309 A1* 7/2016 Khoo ..... F25B 1/00 62/526

(Continued)

*Primary Examiner* — Henry T Crenshaw
(74) *Attorney, Agent, or Firm* — Kirby Drake

(57) ABSTRACT

A dynamic refrigeration system may include an ultrasonic transducer attached to a refrigerant flow sight glass, an expansion valve, and an evaporator coil in a refrigerant line. The ultrasonic transducer may be placed in a refrigerant flow of the refrigerant line before or after the expansion valve and before the evaporator coil, wherein sound waves of the ultrasonic transducer may break up large globules of refrigerant molecules into smaller globules of refrigerant molecules, thereby increasing total surface area of the refrigerant molecules to increase heat transfer capacity and total system efficiency. The system may provide 3-5 percent higher efficiency overall due to the presence of the ultrasonic transducer in the refrigerant line before or after the expansion valve.

8 Claims, 3 Drawing Sheets

(56) References Cited

U.S. PATENT DOCUMENTS

| | | | | |
|---|---|---|---|---|
| 2017/0314825 | A1* | 11/2017 | Scancarello | F25B 49/043 |
| 2018/0094879 | A1* | 4/2018 | Mislak | F25B 49/02 |
| 2019/0360721 | A1* | 11/2019 | Mislak | F24F 6/12 |
| 2020/0292207 | A1* | 9/2020 | Feria | F25B 49/02 |
| 2020/0348051 | A1* | 11/2020 | Rebrovic | F25B 41/40 |

* cited by examiner

REFRIGERATION SYSTEM USING AN ULTRASONIC TRANSDUCER TO INCREASE HEAT TRANSFER EFFICIENCY

CROSS-REFERENCE TO RELATED APPLICATIONS

The present Application is a divisional of, and claims priority to, U.S. patent application Ser. No. 17/214,237 filed Mar. 26, 2021, which is a non-provisional of, and claims priority to, U.S. Patent Application No. 62/994,921, entitled "A System to Continuously Dynamically Adjust Refrigerant Pressures to Maintain OEM Optimum System Rated Efficiency Under Varying Conditions, filed Mar. 26, 2020, the disclosures of which are incorporated by reference in its entirety.

FIELD OF THE DISCLOSURE

The present disclosure generally relates to a dynamic refrigeration system, and more particularly to a system that may automatically fine-tune air conditioning (AC) and refrigeration systems while running.

BACKGROUND

AC, chiller, and refrigeration systems are designed to operate optimally at a chart-specified specific refrigerant pressure (provided by the original equipment manufacturer (OEM)) for each specific refrigerant and at each external temperature (ambient air temperature entering the condensing coil). These systems may be set at one specific low refrigerant pressure and at one specific high refrigerant pressure for the specific ambient temperature (ambient air temperature entering the condensing coil) at the time the technician sets the refrigerant pressure. The system's refrigerant pressure (refrigerant charge) can only be adjusted manually at the equipment during maintenance.

During AC, chiller, and refrigeration systems operations, internal and external heat loads and conditions are constantly changing. These changes, along with other factors, cause operating refrigerant pressures to continually fluctuate above and below optimal efficiency range. Systems are seldom operating at OEM optimal operating efficiency refrigerant pressures because in the initial set up a maintenance service these pressures are initially set at the optimal pressure, according to the OEM pressure optimal charts, for the current external and internal temperatures at the time of the maintenance. As external (ambient) and internal temperatures rise and fall beyond the temperatures that the system was adjusted for at the initial maintenance service, efficiency is lost as external and internal temperatures vary from the temperatures that the system was set for in the initial maintenance service.

Technicians set the refrigerant pressure at a fixed pressure at OEM optimal efficiency at the initial time of service. Immediately, the system internal and external heat loads may change, and the pressure setting is no longer optimal. For example, the technician sets the system pressures at OEM optimal efficiency at 10 AM and the ambient temperature is 85 degrees F.; the internal heat load is 20 persons in an office with the internal comfort thermostat set at 76 degrees F. At 1:30 PM, the ambient temperature is 90 degrees F., the office personnel are just returning from lunch, and external doors are being opened letting heat in and the personnel turn down the internal temperature comfort thermostat to 74 degrees F. With the increased internal and external heat loads, the system is no longer at OEM optimal pressures for maximum efficiency where the technician initially set up the system at 10 AM. As the ambient temperature further increases to 95 degrees F., the system can become up to 15%+ less efficient. System pressure set by technicians at under 70 degrees F. ambient can actually be damaged by high pressures at ambient temperatures over, for example, 105 degrees F. as the external heat causes refrigerant to expand and pressure may exceed system design parameters. In such refrigerant over pressure conditions, the system's high-pressure sensor will shut the system off to prevent damage, and cooling stops until pressures drop below a damaging level. The internal heat load and external heat loads are constantly changing from the (single, static) set conditions when the technician set the system up (when he/she adjusted refrigerant pressure/refrigerant charge volume to OEM optimal for an exact external temperature (set the super heat)).

Operating refrigerant system refrigerant pressures increase as ambient temperature (external heat load) increases (refrigerant gas expands with increased heat) and as internal heat load increases (for example, when the internal comfort cooling thermostat temperature setting is lowered, or a door is opened exposing hot air). Under normal operating conditions, the refrigerant operating pressures rarely are at the OEM optimal efficiency pressures. Refrigeration technicians will set a system at (specific refrigerant chart specified, exact) OEM optimal performance refrigeration high pressure for the conditions that exist at the time the technician makes all the settings. These settings are no longer at optimal if internal or external heat loads change. In normal operation, the internal heat load and external heat load vary away from the initial heat loads existing when that the technician originally set the refrigerant pressures for one specific point in time under the one set of conditions that he/she set the pressures (refrigerant charge). As heat loads vary from what they were when the technician set the system, the system becomes less efficient, easily becoming 15%+ less efficient, as internal and external heat loads vary away from the conditions that existed when the technician made the (fixed) settings.

SUMMARY

Embodiments of the present disclosure may provide a dynamic controlled refrigeration system that may automatically (on the fly) adjust, minute by minute, a refrigerant system's refrigerant pressures/refrigerant charge volume to OEM optimal efficiency as the heat loads change, resulting in the system always operating close to OEM optimal efficiency. This dynamic system may automatically instantaneously fine tune and balance (i.e., dynamically changing "superheat" to be set at optimal) on all air conditioning, heat pump, and refrigeration systems as the internal and external heat loads are continuously changing dynamically. The system may include a small liquid refrigerant pump and refrigerant storage tank, one or more Bluetooth or wired pressure transducers and temperature sensors, and a "brain", a computerized controller, to make decisions to keep the system instantaneously set at factory specs all the time. The system may include a Wi-Fi or wired or wireless Wi-Fi or Ethernet or cell phone or CDPD or other wireless communication means so it can instantaneously report its operating condition, loads, and cost of operating to customer maintenance and operations.

The system according to embodiments of the present disclosure can be installed while running by any AC or refrigeration technician. No cutting, soldering, or downtime may be required. The system may provide quick payback. For the relatively low cost of the system, the customer may pay 15% less for electricity for the life of the AC and refrigeration equipment, and the system according to embodiments of the present disclosure can be installed on the customer's new system for its lifetime, and on the customer's next replacement system also. The small liquid refrigerant pump may eventually wear out, but it can be replaced inexpensively.

Embodiments of the present disclosure may provide a dynamic refrigeration control system comprising: a programmable logic controller (PLC); two PLC-operated valves; a refrigerant reservoir for adding or removing refrigerant; a liquid refrigerant pump connected to the two PLC-operated valves and the refrigerant reservoir; an evaporator coil; a compressor; a compressor coil; a plurality of pressure sensors operating through high-pressure and/or low-pressure refrigerant lines; and a plurality of temperature sensors comprising a temperature sensor located on an input side of the condenser coil, a temperature sensor located on an output side of the condenser coil, and a temperature sensor located adjacent to a low-pressure side of the compressor, wherein the PLC senses whether the compressor is running, and when the compressor is running, measures the plurality of temperature sensors and the plurality of pressure sensors, stores a difference between a high-side temperature and a temperature at the temperature sensor on the input side of the condenser coil (ΔTX) and a difference between a temperature on the output side on of the condenser coil (ΔTY), wherein when ΔTX>ΔTY refrigerant is added and when ΔTY>ΔTX refrigerant is removed. At least one of the two PLC-operated valves may be in communication with a new evaporator low side Schrader valve (NELV) that is connected to the evaporator coil. The plurality of pressure sensors may include high-pressure and/or low-pressure sensors. The plurality of pressure sensors may include a pressure sensor on a low-pressure side of the compressor and a pressure sensor on a high-pressure side of the compressor. Each of the PLC-operated valves may be modulated open and closed and tested by the PLC to identify a difference between a low-side temperature and a temperature at the temperature sensor located adjacent to the low-pressure side of the compressor (ΔTE) (Superheat). After each opening and closing of each of the PLC-operated valves, ΔTE is tested such that it is always ΔTE>5° F. or valve operation stops until it goes above 5° F. The PLC may make a determination as to refrigerant type.

Other embodiments of the present disclosure may provide a dynamic refrigeration control system comprising: an ultrasonic transducer attached to a refrigerant flow sight glass; an expansion valve; and an evaporator coil in a refrigerant line, wherein the ultrasonic transducer is placed in a refrigerant flow of the refrigerant line before or after the expansion valve and before the evaporator coil, wherein sound waves of the ultrasonic transducer break up large globules of refrigerant molecules into smaller globules of refrigerant molecules, thereby increasing total surface area of the refrigerant molecules to increase heat transfer capacity and total system efficiency, and wherein the system provides 3-5 percent higher efficiency overall due to the presence of the ultrasonic transducer in the refrigerant line before or after the expansion valve. The refrigerant line may be formed of a material that is not soft to avoid attenuating ultrasonic sound waves/energy. The refrigerant line may be formed of a non-ductile steel, copper, or other metal that transfers ultrasonic waves to the refrigerant flow inside the refrigerant line. The ultrasonic transducer may be attached directly to the refrigerant line. The transducer may be made integral with the expansion valve. The ultrasonic transducer may be placed in the refrigerant line so that a head of the ultrasonic transducer is in the refrigerant flow. The ultrasonic transducer may be bonded to or mechanically affixed to a sight gauge, the refrigerant line, the expansion valve, and/or a refrigerant filter case. The sound waves of the ultrasonic transducer may release imbedded trace moisture water molecules out of the large globules of refrigerant molecules and globules of compressor oil molecules where the refrigerant flow carries the trace moisture to a refrigerant flow dryer that absorbs the trace moisture. The sound waves of the ultrasonic transducer may release imbedded compressor oil lubricant out of the large globules of refrigerant molecules and globules of compressor oil molecules where the refrigerant flow carries the compressor oil lubricant to a compressor sump where the compressor may use the lubricant. The sound waves of the ultrasonic transducer may release imbedded foreign matter and debris imbedded in the large globules of refrigerant molecules and globules of compressor oil molecules where the refrigerant flow carries the foreign matter and debris to a refrigerant flow filter where it may be removed from the refrigerant flow. The sound waves of the ultrasonic transducer may release imbedded products of compressor lubricant oil degradation imbedded in the large globules of refrigerant molecules and globules of compressor oil molecules where the refrigerant flow carries the products of compressor lubricant oil degradation to a refrigerant flow filter dryer where it may be removed from the refrigerant flow.

Further embodiments may provide a method for dynamic refrigeration control flow comprising: using a programmable logic controller (PLC), sensing whether a compressor is running; when the compressor is running, measuring a plurality of temperature sensors and a plurality of pressure sensors, the plurality of pressure sensors operating through high-pressure and/or low-pressure refrigerant lines and the plurality of temperature sensors comprising a temperature sensor located on an input side of a condenser coil, a temperature sensor located on an output side of the condenser coil, and a temperature sensor located adjacent to a low-pressure side of the compressor; and storing a difference between a high-side temperature and a temperature at the temperature sensor on the input side of the condenser coil (ΔTX) and a difference between a temperature on the output side on of the condenser coil (ΔTY), wherein when ΔTX>ΔTY refrigerant is added and when ΔTY>ΔTX refrigerant is removed. The method may further comprise modulating PLC-operated valves open and closed; and using the PLC, testing the PLC-operated valves to identify a difference between a low-side temperature and a temperature at the temperature sensor located adjacent to the low-pressure side of the compressor (ΔTE) (Superheat), wherein after each opening and closing of each of the PLC-operated valves, ΔTE is tested such that it is always ΔTE>5° F. or valve operation stops until it goes above 5° F.

BRIEF DESCRIPTION OF THE DRAWINGS

For a more complete understanding of this disclosure, reference is now made to the following description, taken in conjunction with the accompanying drawings, in which.

DETAILED DESCRIPTION

Figure 1:
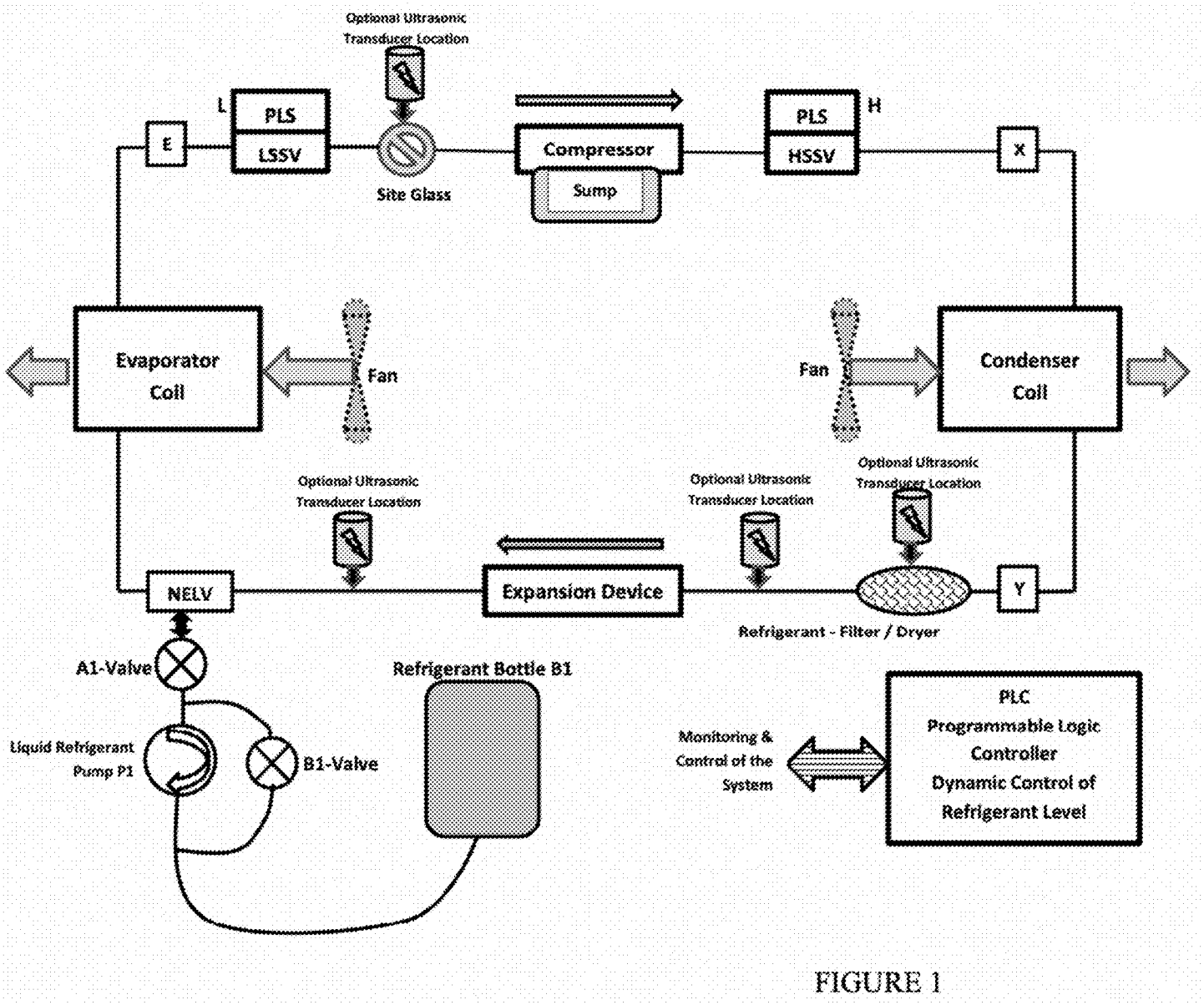
FIG. 1 depicts a dynamic refrigeration system according to an embodiment of the present disclosure.

Embodiments of the present disclosure may provide a dynamic refrigeration control system that may automatically, at pre-determined time periods on-the-fly, adjust a refrigerant system's refrigerant pressures to predetermined optimal efficiency pressures as the internal and external heat loads change over a range. This may result in the refrigerant system pressures closely operating within a range of predetermined optimal efficiency pressures. A refrigeration system's optimal efficiency parameters may be determined by referring to the equipment or the refrigerant OEM's recommendations or by other sources or by research or scientific methods in embodiments of the present disclosure.

Embodiments of the present disclosure may provide an ultrasonic transducer that may be attached to a unit that may provide observation of a process fluid or a feature, such as a refrigerant flow sight glass formed of glass or plastic or other similar materials, or in a refrigerant tubing well device, in a refrigerant flow after the expansion valve and before the evaporator coil in a warm refrigerant line. The refrigerant line may be formed glass, plastic, metals, or other materials that are not soft, as soft material may attenuate the ultrasonic sound waves/energy. It should be appreciated that if metal refrigerant flow tubing is utilized, the metal should be a thin wall non-ductile steel, or copper, or another material that may efficiently transfer ultrasound waves to the refrigerant flow inside the refrigerant tubing.

The transducer may be attached directly to the refrigerant line. It should be appreciated that the transducer may be attached before or after the expansion valve or may be made an integral part of the expansion valve in embodiments of the present disclosure. It also should be appreciated that the ultrasonic transducer may be placed in the refrigerant flow and/or on a sight gauge just before the condensing unit/condensing coil in embodiments of the present disclosure.

In embodiments of the present disclosure, the ultrasonic transducer may be placed in a refrigerant tubing well so that the transducer head is in the refrigerant flow. In other embodiments of the present disclosure, the ultrasonic transducer may be placed on the refrigerant flow tubing so that the transducer head is in the refrigerant flow regardless whether a refrigerant well is present. In some embodiments of the present disclosure, the ultrasonic transducer may be bonded to or mechanically affixed to a sight gauge, refrigeration tubing, expansion valve, and/or refrigerant filter case.

The ultrasonic transducer sound waves may break up large globules of refrigerant molecules into smaller globules of refrigerant molecules, thereby increasing the total surface area of the refrigerant molecules. Accordingly, the total surface area of the refrigerant molecule globules may be increased and may transport more heat, increasing the refrigerant system heat transfer capacity and total system efficiency. The ultrasonic transducer sound waves, while breaking the large refrigerant globules of molecule into smaller globules, may release imbedded trace moisture water molecules out of the large globules of refrigerant molecules and globules of compressor oil molecules where the refrigerant flow will carry the trace moisture to the refrigerant flow dryer that may absorb the trace moisture. The ultrasonic transducer sound waves, while breaking the large refrigerant globules of molecules into smaller globules, may release imbedded compressor oil lubricant out of the large globules of refrigerant molecules and globules of compressor oil molecules where the refrigerant flow will carry the compressor oil lubricant to the compressor sump where the compressor may use the lubricant. The ultrasonic transducer sound waves, while breaking the large refrigerant globules of molecules into smaller globules, may release imbedded foreign matter and debris imbedded in the large globules of refrigerant molecules and globules of compressor oil molecules where the refrigerant flow may carry the foreign matter and debris to the refrigerant flow filter where it may be removed from the refrigerant flow. The ultrasonic transducer sound waves, while breaking the large refrigerant globules of molecules into smaller globules, may release imbedded products of compressor lubricant oil degradation imbedded in the large globules of refrigerant molecules and globules of compressor oil molecules where the refrigerant flow may carry the products of compressor lubricant oil degradation to the refrigerant flow filter dryer where it may be removed from the refrigerant flow.

A system according to embodiments of the present disclosure may be 3-5 percent higher efficiency overall due to the presence of the ultrasonic transducer in the refrigerant line before or after the expansion valve and its above effects. In this embodiment of the present disclosure, the ultrasonic transducer in the refrigerant line may be placed before the refrigerant expansion valve or it may be placed before the condensing coil or condensing unit. The ultrasonic transducer in the refrigerant flow may be placed on the outside of the housing or outside of the case of a refrigerant flow filter or filter dryer. The ultrasonic transducer in the refrigerant flow may be placed on a sight gauge in the refrigerant flow before a refrigerant filter or refrigerant filter dryer.

A system according to embodiments of the present disclosure may provide approximately 1 or more percent higher efficiency overall due to the presence of the ultrasonic transducer applied to the refrigerant flow as enters the condensing coil. It should be appreciated that the ultrasonic transducer may be activated while the compressor is running, and it may not run while the compressor is not running.

FIG. 1 depicts an air conditioning refrigerant control system according to an embodiment of the present disclosure. The system may include two 24 VDC PLC-operated valves (depicted as A1-valve and B1-valve herein) that may be connected to a liquid refrigerant pump (P1 pump). The liquid refrigerant pump may be connected to a refrigerant bottle (B1) or another similar refrigerant reservoir for adding or removing refrigerant. At least one of the valves may be in communication with a new evaporator low side Schrader valve (NELV) that is connected to an evaporator coil, a fan coil for the refrigerant to pick up a heat load.

As depicted herein, a plurality of pressure transducers or sensors may be attached the refrigerant system through high-pressure and/or the low-pressure refrigerant lines/service ports. The pressure sensors included in the system may be high-pressure and/or low-pressure sensors in embodiments of the present disclosure. For example, PLS may represent a pressure sensor on the suction or low-pressure side (LSSV) of the compressor. PHS may represent a pressure sensor on the output or high-pressure side (HSSV) of the compressor. X may represent a temperature sensor of the refrigerant pipe entering the condenser coil and may be located on the input side of the condenser coil (the fan coil for refrigerant to release a heat load). Y may represent a temperature sensor of the refrigerant pipe exiting the condenser coil (i.e., on the output side of the condenser coil). E may represent a temperature sensor of the refrigerant pipe entering the compressor (suction side), and this temperature sensor may be located adjacent to the LSSV. It should be appreciated that the sensors should be linear and may be 0 to 10 vdc or 0 to 5 vdc as depicted herein. In many cases, no soldering is necessary as the existing service ports or threaded Schrader valve ports or other existing service ports may be used.

In operation, once an air conditioning (AC) unit is turned on, the AC unit should run for approximately 15 minutes before any change is made using the programmable logic controller (PLC). Following this warm-up, the PLC may measure the low-side pressure and the high-side pressure and convert both to individual temperatures ($T_{LS}$ and $T_{HS}$) by referencing a specific stored refrigerant array for the given refrigerant stored in the PLC. A specific refrigerant type should be selected before the PLC AC or refrigeration system control is activated. The PLC may then store the low-side pressure temperature ($T_{LS}$) and the high-side pressure temperature ($T_{HS}$). Temperatures X, Y, E may be measured and stored by the PLC. The PLC stores the difference between $T_{HS}$ and $T_X$ ($\Delta T_X$), the difference between $T_Y$ and $T_{HS}$ ($\Delta T_Y$), and the difference between $T_{LS}$ and $T_E$ ($\Delta T_E$) (Superheat). It should be appreciated that if $\Delta T_X > \Delta T_Y$ refrigerant should be added. Valve L would be modulated open and closed, and the results would be tested by the PLC. If $\Delta T_Y > \Delta T_X$ refrigerant would be removed. Valve H would be modulated open and closed, and the results would be tested by the PLC. After each opening and closing of either valve, $\Delta T_E$ must be tested such that it is always $\Delta T_E > 5°$ F., or the valve operation must stop until it goes above 5° F. A Red 24 VDC Panel LED would be driven to one of the PLC outputs to indicate that $\Delta T_E < 5°$ F.

Figure 2:
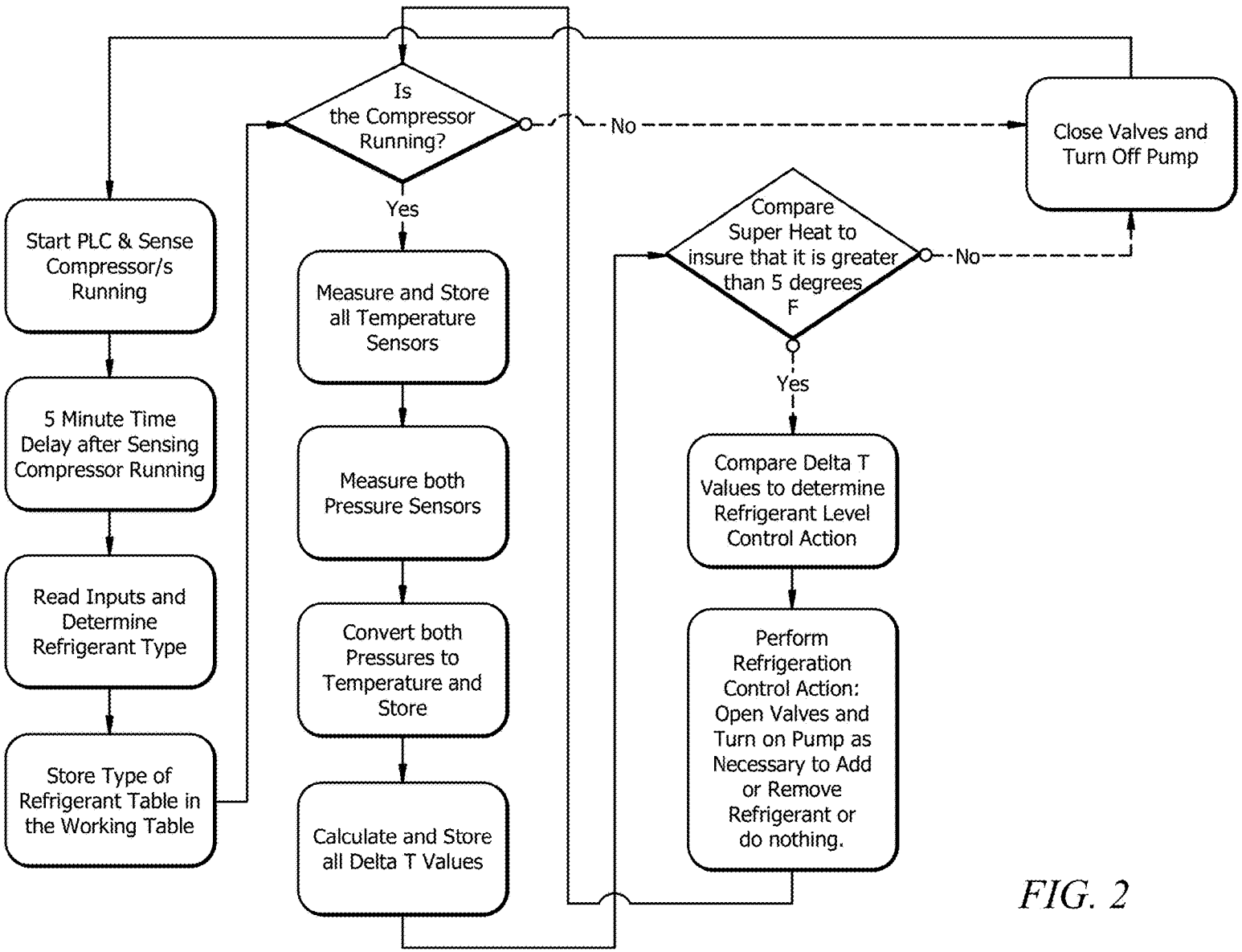
FIG. 2 depicts a dynamic refrigeration control flow diagram for PLC control according to an embodiment of the present disclosure.

FIG. 2 depicts a dynamic refrigeration control flow diagram for PLC control according to an embodiment of the present disclosure. As depicted herein, the PLC may be started and sense whether the compressor is running. There may be approximately a 15-minute time delay after sensing that the compressor is running. Inputs may be read, and a determination may be made as to the refrigerant type. The type of refrigerant may be stored in a working table. If the compressor is running, the temperature sensors may be measured, and the readings may be stored. The pressure sensors also may be measured. Both the pressures and temperatures may be converted and stored, and all delta T values may be calculated and stored. The Superheat may be compared to ensure that it is greater than 5° F. If it is greater than 5° F., the delta T values may be compared to determine the refrigerant level control action. The refrigerant control action may then be performed by opening the valves and turning on the pump as necessary to add or remove refrigerant or do nothing. If the Superheat is not greater than 5° F., the valves may be closed, and the pump may be turned off.

As previously discussed, several of the input terminals to the PLC may be 0 to 24 vdc digital inputs. A 24 vdc input represents a logic 1, and 0 vdc input represents a zero. It should be appreciated that the PLC may need to be programmed for the system type of refrigerant before the PLC is shipped to be installed in a system. In such case, a jumper may be installed from the 24 VDC power source terminal to an input that corresponds to the refrigerant that is being selected (1). All others would be left disconnected (0).

| | |
|---|---|
| Input Refrigerant #1=R410a | I-2 |
| Input Refrigerant #2=R134a | I-3 |
| Input Refrigerant #3=R407C | I-4 |
| Input Refrigerant #4=R404a | I-5 |
| Input Refrigerant #4=R507 | I-6 |
| Input Refrigerant #4=R11 | I-7 |
| Input Refrigerant #4=R123 | I-8 |
| Input Refrigerant #4=R22 | I-9 |

For example, if pressure sensor "L" indicated that the pressure was 34.5 psig and input #2 was jumped to I-1, 24 Vdc, then the refrigerant is R134a, and the corresponding Temperature is 40° F. and would be stored as $T_{LS}$=40° F.

Figure 3:
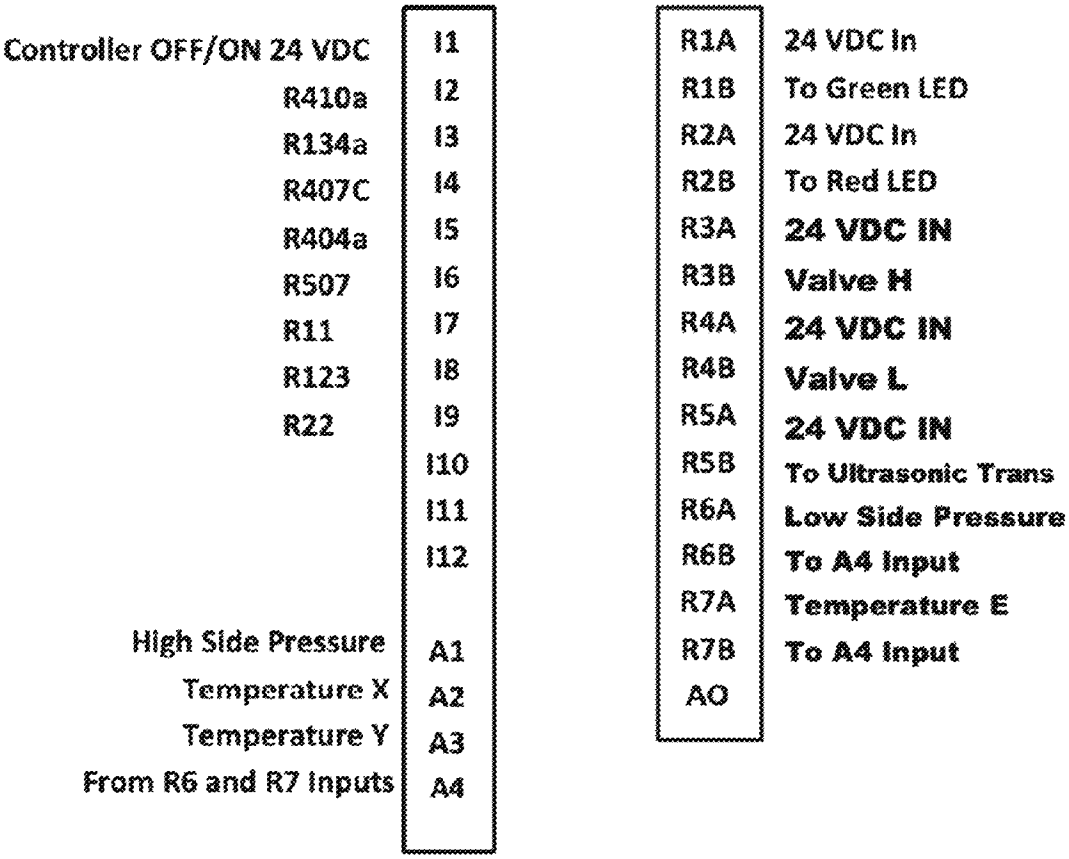
FIG. 3 depicts status indicators according to an embodiment of the present disclosure.

There may be two external status indicators that would be panel-mounted 24 vdc LEDs driven by the output relays of the PLC (FIG. 3). The system "OK" green LED may be illuminated when both valves are closed, and the Superheat ($\Delta T_E$) is greater than 5° F. The valves locked, closed red LED may be illuminated when the Superheat ($\Delta T_E$) is less than or equal to 5° F.

Embodiments of the present disclosure may enable maintenance of a specific liquid level of refrigerant in the condenser coil (output side of the compressor) while ensuring that the refrigerant entering the suction side or input side of the compressor is always vapor and never liquid. Liquid into the suction or input side of the compressor would damage the compressor.

The following equation describes a control process according to embodiments of the present disclosure: $0.65 > [(T_{HS}-T_Y)/(T_X-T_Y)] > 0.5$. When $[(T_{HS}-T_Y)/(T_X-T_Y)]=0.65$, the condenser coil is approximately ⅔ full of liquid refrigerant. When $[(T_{HS}-T_Y)/(T_X-T_Y)]=0.50$, the condenser coil is approximately ½ full of liquid refrigerant. When $[(T_{HS}-T_Y)/(T_X-T_Y)]$ is between 0.50 and 0.65, the system is satisfied. When $[(T_{HS}-T_Y)/(T_X-T_Y)]$ is less than 0.5, the system must add refrigerant through an opening operation of the low side valve "L". When $[(T_{HS}-T_Y)/(T_X-T_Y)]$ is greater than 0.65, the system must remove refrigerant through an opening operation of the high side valve "H". Permission to operate these valves depends upon Superheat: $\Delta T_E$ must be tested before valve opening operation begins and after each valve closing operation. $\Delta T_E$ must be tested such that it is always $\Delta T_E > 5°$ F. If not, the valve operation must stop until $\Delta T_E$ goes above 5° F.

In some embodiments of the present disclosure, the system may include at least one temperature sensor in the condenser coils and/or the evaporator coils to sense their temperature. In some embodiments of the present disclosure, at least one temperature sensor may be placed in the system's return air stream and/or in the system's supply air stream. Embodiments of the present disclosure also may include at least one temperature sensor to sense the ambient air temperature of the air entering the condensing coils. Ports connected to the condenser coils and/or evaporator coils may each have at least one sensor that may be connected to the PLC.

In an optional embodiment of the present disclosure, the system may route the condenser fan motor power wires serially through a motor speed controller, which may be included in the PLC, that may include at least one temperature sensor that may be placed in the condensing coil according to the device's instructions. This may control the condensing fan speed to maintain a set constant condensing coil operating temperature set to optimal OEM/pre-determined condensing coil operating temperature. This may protect the compressor when the system is running at low ambient temperatures. The system according to embodiments of the present disclosure may optionally replace a condenser fan blade with a high-efficient blade to increase system efficiency.

The system may include refrigeration tubing "T" in the suction line of the refrigerant system. The system may run a refrigerant line from the suction "T" to a refrigeration (or vacuum) pump and then to a refrigerant recovery tank with a filter dryer in line between the pump and at least one electronic refrigeration open and closed valve. At least one pressure sensor may be placed on the refrigerant tubing from the recovery tank as depicted in FIG. 1 in an embodiment of the present disclosure. In embodiments of the present disclosure, the system may determine the size of the refrigerant recovery tank by determining the average difference (typically in pounds) in weight in the system's refrigerant fill at its lowest operating temperature range and at its highest temperature operating range, plus a reserve for leakage. The refrigerant tank fill level may be determined at system setup, and refrigerant may be added to or removed from the recovery tank as desired. The system may use a refrigerant tank with a float switch or other type of switch to indicate to the PCL that the refrigerant level in the tank is full and can receive no more refrigerant.

The system may include at least one electronic refrigeration open and closed valve ("electronic valve") outgoing from the "T." In some embodiments of the present disclosure, the system may include a removable or non-removable cartridge refrigerant filter dryer in the suction line of the compressor, preferably with a service valve at both ends to determine differential pressure. A filter dryer may be in the refrigeration line between the pump and the electronic valve.

The system may, upon command from a PLC or other electronic controller, control at least one electronic valve. The at least one electronic valve can be opened and closed and may control the refrigerant pump which may be turned on and off to pump refrigerant from the refrigerant system's suction line into the recovery tank (thus, lowering system pressures). In other embodiments of the present disclosure, the valve may open (the pump will not run) to allow refrigerant to run into the refrigerant system suction line from the pressurized recovery tank into the refrigerant system (thus, increasing refrigerant system pressures). The system may include wire connections routed from a PLC to each sensor and to the electronic valve on the suction line and to the refrigerant pump as depicted in FIG. 1.

The system may program the PLC to sense the system's current operating conditions, temperatures, and pressures. The PLC may be programmed to dynamically, on the fly, while the system is running, adjust the system refrigerant pressures to factory/OEM/pre-determined optimal efficiency pressures for all the sensor values sensed, by pumping refrigerant into the recovery tank (system pressure too high, refrigerant needs to be removed from the system) or flowing refrigerant from the pressurized recovery tank into the suction line (system pressure too low, refrigerant needs to be added to the system from the pressurized recovery tank). Embodiments of the present may, on-the-fly, dynamically control the system's refrigerant pressures versus the ambient temperature while the system is running according to the refrigerant manufacturer's or the equipment manufacturer's pressure versus a temperature chart. This may be accomplished by a system of high refrigerant line and low refrigerant line pressure transducers or sensors, and ambient temperature sensors, the electronic valve, refrigerant pump and refrigerant recovery tank along with a PLC to adjust the refrigerant pressures while running according to the refrigerant manufacturer's or equipment manufacturer's pressure versus temperature chart.

As the system operates, the PLC may constantly monitor temperatures and pressures. The PLC may activate the electronic valve and start the refrigerant pump to remove refrigerant from the system to lower system pressure by removing refrigerant from the system and pumping it into the recovery tank. The PLC may start, stop, and control the pumping duty cycle and speed in proportion to the amount of error detected by the PLC determination in the refrigerant level. The PLC may open the electronic valve to allow refrigerant to flow from the pressurized recovery tank into the refrigerant system or may pump refrigerant from the refrigerant tank into the refrigerated system to increase system refrigerant pressure. By this method according to embodiments of the present disclosure, the PLC may maintain the system pressures to the OEM/pre-determined optimal pressures parameters over a wide range of internal and external heat loads. Thus, the refrigeration system may continue to operate at OEM/pre-determined optimal efficiency within its design operating range and may increase operating efficiencies by 15% (at least) or higher, dynamically, whenever the system is running.

The PLC may be programmed to keep the system running at OEM optimal efficiency throughout a broad range of conditions within the refrigeration system's compressor design parameters. The PLC may allow the refrigeration system to operate efficiently beyond the OEM's design parameters, under high internal heat loads such as those existing in refrigerated warehouses. This may be of great value in high ambient temperature conditions such as in the desert or in very low ambient temperature conditions, such as frigid climates.

The system may incorporate a capillary, fixed orifice, or an electronic thermostatic (TXV) expansion valve device which may be controlled by the PLC. The system may include high and low pressure and high and low temperature safety system shut-off capability which may be controlled by the PLC. The system may include a compressor oil heater which may be controlled by the PLC. The system may include a device to adjust the power factor to optimal level. This power factor system may be a fixed device with a single setting, or it may be adjustable and controlled by the PLC.

The PLC may be programmed to control the system operating at OEM/pre-determined optimal efficiency through very broad ranges of conditions within the system's design parameters. The system may be constructed with at least one ultrasonic transducer or mechanical vibrator in the refrigerant flow line between the TXV and/or refrigerant metering device and the evaporator coil or elsewhere. At least one ultrasonic transducer or mechanical or electronic or sonic vibrator may be attached to the external diameter or inner diameter of the refrigerant line from the TXV and/or refrigerant metering device to the evaporator coil or condensing coil to disturb the liquid and vapor exiting the TXV and/or refrigerant metering device valve after the refrigerant pressure drops. Such ultrasonic transducer or mechanical vibrator disturbance may break up globules of refrigerant molecules and globules of compressor oil molecules, thereby increasing the refrigerant's total molecular surface area, and may break up the globules of compressor lubricant to minimize oil-fouling onto refrigerant heat transfer tube lumens. Such disturbance may be accomplished by mechanical vibration. The frequency of the ultrasonic/vibration waves, the strength of the ultrasonic/vibration waves, and the timing of the pulsing, if any, between ultrasonic/vibration waves and the duration of the ultrasonic/vibration waves may vary based on refrigerants, rates of refrigerant flow, compressor oils, and construction and configuration of the evaporator/condensing coils and other variables. Similarly, the system may have at least one electronic ultrasonic transducer or mechanical vibrator that may be used on the high-pressure refrigerant line entering the condensing coil to disturb the refrigerant and the compressor oil molecular globules and to increase the coils' efficiency. The system according to embodiments of the present disclosure may accomplish such disturbance by mechanical vibration with or without ultrasonic disturbance.

The system as a whole, and/or the PLC or controller may have Wi-Fi, Ethernet, serial, parallel, Bluetooth, cell phone or other communication methods to communicate with other internal or external devices. The PLC may have Wi-Fi, Ethernet, serial, parallel, Bluetooth, cell phone, or other communication methods for external devices to communicate with and may remotely control or adjust or program or update or download or upload the refrigeration system PLC. This may be accomplished by smartphone "app" (application) or an online program or a program that may be provided in a computer.

The system according to embodiments of the present disclosure may include power factor adjusting devices on the electrical power wires leading from a power source into the system. The system may include, on the electrical power wires leading into the compressor and the PLC, devices to control and minimize electrical interference and power spikes such as surge suppressors or isolation transformers or toroid coils or ferrite coils. The system may include, on the electrical power wires leading into the compressor and the PLC, magnetic torrid devices that may control and minimize electrical interference and RF signals on the power lines. The system may include a high efficiency condensing fan blade.

It should be appreciated that there are some components within a system according to embodiments of the present disclosure that may be optionally employed, such as for data logging and calculating/monitoring system efficiency. For example, while at least one transducer may be attached to the compressor's high-pressure refrigerant/service lines, there may be embodiments of the present disclosure where at least one transducer may be attached to the low-pressure refrigerant/service lines. It should be appreciated that these transducers may be attached to existing ports without soldering. At least one temperature sensor may be placed in the ambient air flow entering the condenser coils. Optionally, at least one temperature sensor may be placed in condenser coils and/or evaporator coils and/or in the system's return air stream and/or in the system's supply air stream. It should be appreciated that there may be some systems where refrigerant filter dryers may not already be included in the system. If there are no refrigerant filter dryers, optionally, removable cartridge refrigerant filter dryers may be placed in the suction line of the compressor and/or in the high-pressure line of the compressor. A service valve may be included at both ends for checking differential pressure or temperature sensors installed on the refrigerant lines adjacent to each side of the filter to determine if the filter is clogged and needs replacement.

The system according to embodiments of the present disclosure may be effective where the internal heat loads vary over a wide range, such as a refrigerated warehouse, or any environment where internal heat loads very greatly. The system may be effective where external heat load/ambient temperatures vary greatly, such as in desert environments where daily ambient temperatures may range from approximately 50 degrees F. to 130 degrees F.

It should be appreciated that the system according to embodiments of the present disclosure may provide an exciter that may include two exciter transducers that may generate sonic/ultrasonic waves, a controller that may control power to the transducers, and a transducer mounting frame that may enclose and hold the transducers against a refrigerant filter with the aid of clamps. The controller may be powered by 24 VAC (such as may be provided through an internal control transformer) at approximately 300 milliamps on the input power terminals. With single phase units and some three-phase units, 24 VAC may not be available, and a step-down transformer can be installed that has a 120/208/240/480 VAC tapped selectable primary with a 24 VAC secondary with a minimum power rating of 50 VA. Stranded or solid wire can be used to connect the controller to 24 VAC in embodiments of the present disclosure. Solid state electronics devices may be used to provide voltages needed.

The controller may power and control one or both sonic/ultrasonic transducers (SUSTs) simultaneously for two refrigerant filters in embodiments of the present disclosure. It should be appreciated that the SUSTs should not be plugged into the controller when power is on to avoid damaging the SUSTs and also to increase the life of the SUSTs. The controller may be mounted inside the power and control area with double-sided tape or other attachment method. The SUSTs may be mounted to the refrigerant filter dryers wherever they are located, whether inside or outside.

When the controller initiates operation of the SUSTs, an LED indicator may be illuminated to indicate that sonic/ultrasonic energy is being coupled from the transducers to the refrigerant filter dryer. In embodiments of the present disclosure, the LED indicator may illuminate for 1 minute and then turn off for approximately 2-4 minutes. It should be appreciated that the LED indicator may cycle on and off continuously as the unit reduces refrigerant flow resistance within the refrigerant filter dryer. The drive signal for the transducers may be ramped up and down to improve the richness of the Harmonic Frequency Spectrum. This may allow the energy to be absorbed by virtually any sized particle through the process of mechanical resonance.

The exciter may be installed within an air conditioner, heat pump, RTU, or packaged outside unit. The controller may be located in close proximity to the electrical power control section and installed to a bulkhead with double-sided tape or other attachment method inside the unit. To install the transducer(s), the refrigerant filter dryer may be located. The curved side of one transducer may be placed inside the curved side of the transducer mounting frame. The frame and transducer may be placed over the refrigerant filter dryer. Clamps may be wrapped around the frame, transducer, and filter. The transducer(s) may be plugged into the controller.

Although the present disclosure and its advantages have been described in detail, it should be understood that various changes, substitutions and alterations can be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

The invention claimed is:

1. A dynamic refrigeration control system comprising:

an ultrasonic transducer attached to a refrigerant flow sight glass, the ultrasonic transducer producing sound waves that break up globules of refrigerant molecules into relatively smaller globules of refrigerant molecules, thereby increasing total surface area of the refrigerant molecules to increase heat transfer capacity and total system efficiency;

an expansion valve;

an evaporator coil in a refrigerant line, wherein the ultrasonic transducer is placed in a refrigerant flow of the refrigerant line before or after the expansion valve positioned between the evaporator coil and a condenser coil and before or after a compressor positioned between the evaporator coil and the condenser coil, and wherein the system provides 3-5 percent higher efficiency overall due to the presence of the ultrasonic transducer in the refrigerant line before or after the expansion valve.

2. The system of claim 1, wherein the refrigerant line is formed of a non-ductile steel, copper, or other metal that transfers ultrasonic waves to the refrigerant flow inside the refrigerant line.

3. A dynamic refrigeration control system comprising:

an ultrasonic transducer attached directly to a refrigerant line, the ultrasonic transducer producing sound waves that break up globules of refrigerant molecules into relatively smaller globules of refrigerant molecules, thereby increasing total surface area of the refrigerant molecules to increase heat transfer capacity and total system efficiency;

an expansion valve;

an evaporator coil in the refrigerant line, wherein the ultrasonic transducer is placed in a refrigerant flow of the refrigerant line before or after the expansion valve positioned between the evaporator coil and a condenser coil and before or after a compressor positioned between the evaporator coil and the condenser coil, and wherein the system provides 3-5 percent higher efficiency overall due to the presence of the ultrasonic transducer in the refrigerant line before or after the expansion valve.

4. The system of claim 1, wherein the ultrasonic transducer is part of the sight glass and placed in the refrigerant line so that a head of the ultrasonic transducer extends through the sight glass and is in the refrigerant flow.

5. The system of claim 1, wherein the sound waves of the ultrasonic transducer release imbedded trace moisture water molecules out of the large globules of refrigerant molecules and globules of compressor oil molecules where the refrigerant flow carries the trace moisture to a refrigerant flow dryer that absorbs the trace moisture.

6. The system of claim 1, wherein the sound waves of the ultrasonic transducer release imbedded compressor oil lubricant out of the large globules of refrigerant molecules and globules of compressor oil molecules where the refrigerant flow carries the compressor oil lubricant to a compressor sump where the compressor may use the lubricant.

7. The system of claim 1, wherein the sound waves of the ultrasonic transducer release imbedded foreign matter and debris imbedded in the large globules of refrigerant molecules and globules of compressor oil molecules where the refrigerant flow carries the foreign matter and debris to a refrigerant flow filter where it may be removed from the refrigerant flow.

8. The system of claim 1, wherein the sound waves of the ultrasonic transducer release imbedded products of compressor lubricant oil degradation imbedded in the large globules of refrigerant molecules and globules of compressor oil molecules where the refrigerant flow carries the products of compressor lubricant oil degradation to a refrigerant flow dryer where it may be removed from the refrigerant flow.

* * * * *